US005951166A

United States Patent [19]

Matsumoto

[11] Patent Number: 5,951,166

[45] Date of Patent: Sep. 14, 1999

[54] CARRIER-BAG FOR PLATE-SHAPED ARTICLES AND PROCESS FOR PRODUCING THE SAME

[76] Inventor: Masayoshi Matsumoto, 8-7-40, Tsujii, Himeji-Shi, Hyougo-Ken, Japan

[21] Appl. No.: 09/063,056

[22] Filed: Apr. 21, 1998

[30] Foreign Application Priority Data

Jan. 26, 1998 [JP] Japan ..... 10-012954

[51] Int. Cl.[6] ..... B65D 30/20; B65D 33/08

[52] U.S. Cl. ..... 383/10; 383/120; 383/122; 383/903

[58] Field of Search ..... 383/120, 104, 383/10, 17, 122, 903

[56] References Cited

U.S. PATENT DOCUMENTS

| | | | |
|---|---|---|---|
| 2,138,119 | 11/1938 | Potdevin et al. | 383/903 |
| 2,628,764 | 2/1953 | Rubinstein et al. | 383/120 |
| 3,107,989 | 10/1963 | Fesco | 383/120 |
| 3,774,837 | 11/1973 | Franson | 383/903 |
| 3,829,007 | 8/1974 | Ellison | 383/104 |
| 3,834,528 | 9/1974 | Pickford et al. | 383/10 |
| 3,987,959 | 10/1976 | Deards et al. | 383/903 |
| 4,353,497 | 10/1982 | Bustin | 393/122 |
| 4,358,466 | 11/1982 | Stevenson | 383/104 |
| 4,428,477 | 1/1984 | Cristofolo | 383/104 |
| 4,810,844 | 3/1989 | Anderson | 383/104 |
| 4,904,093 | 2/1990 | Woods et al. | 383/120 |
| 4,950,859 | 8/1990 | Anderson | 383/104 |
| 5,441,345 | 8/1995 | Garvey et al. | 383/104 |
| 5,676,467 | 10/1997 | Gebhardt | 383/10 |
| 5,741,077 | 4/1998 | Sasaki et al. | 383/903 |

FOREIGN PATENT DOCUMENTS

| | | | |
|---|---|---|---|
| WO 92/09493 | 6/1992 | WIPO | 383/122 |

*Primary Examiner*—Stephen P. Garbe
*Attorney, Agent, or Firm*—Young & Thompson

[57] ABSTRACT

A carrier-bag for plate-shaped articles which a rectangular containing part made of a film folded in a W shape and having a structure in which each pair of an outer film and an inner film of the W-shaped film is separately heat sealed together at both side edges of the containing part, and a pair of holding parts formed by upward extension of the outer films of the W-shaped film and having finger holes; and a process for producing the carrier-bag which comprises forming a belt-shaped film having W-shaped gazette foldings at both side edges from a long tubular plastic film, inserting a heat insulating receiving plate into the central part of each W-shaped gazette folding of the belt-shaped film and pushing heat sealing blades to the receiving plate from both sides to separately heat seal each pair of an outer film and an inner film of the W-shaped film together, cutting the belt-shaped film to produce pieces having a length corresponding to the width of a carrier-bag, cutting the obtained pieces along the center line in the longitudinal direction, and punching finger holes in the holding parts.

The carrier-bag for plate-shaped articles made of a plastic film has a simple structure, is easily handled, can be produced economically in accordance with a simple process, and contains plate-shaped articles horizontally.

8 Claims, 12 Drawing Sheets

Fig. 1(a) —Prior Art—
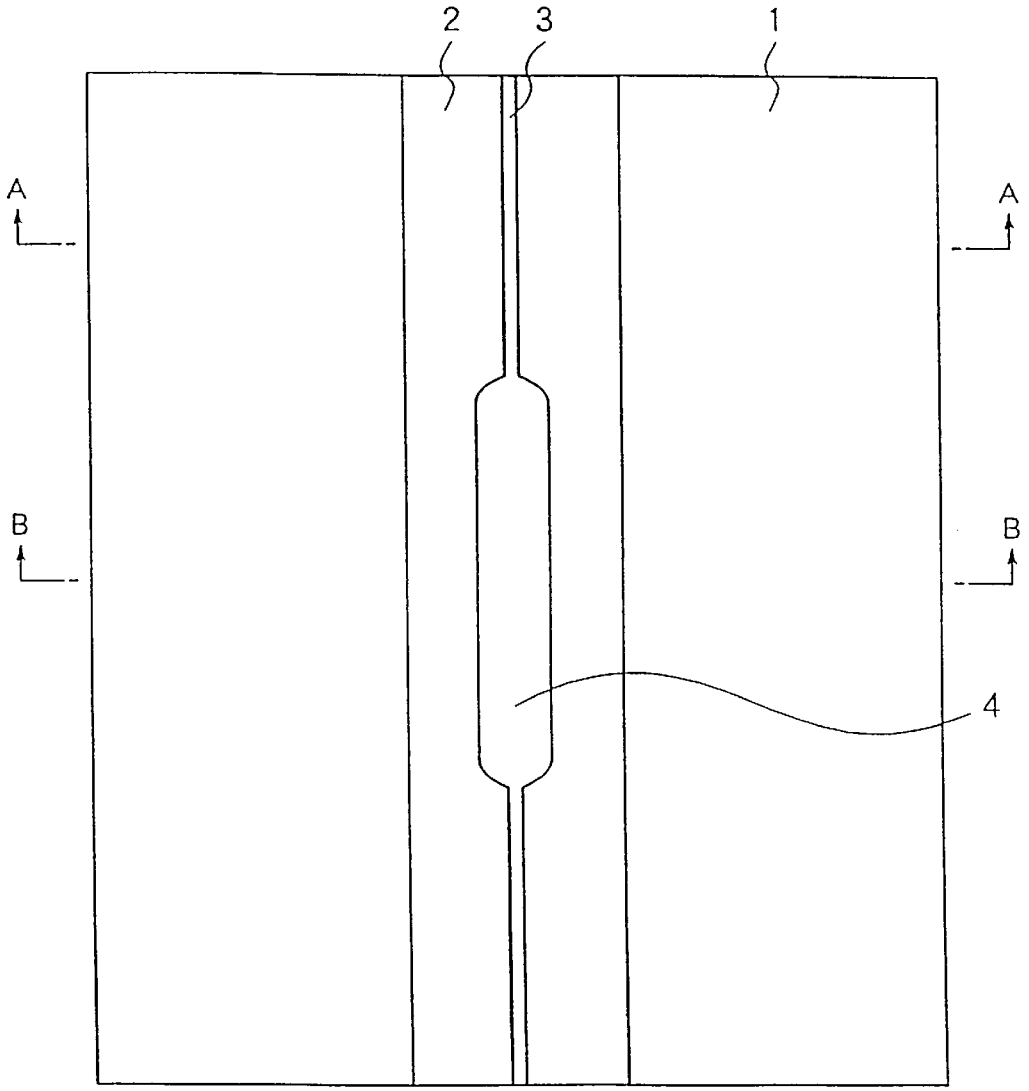
Fig. 1(b) —Prior Art—
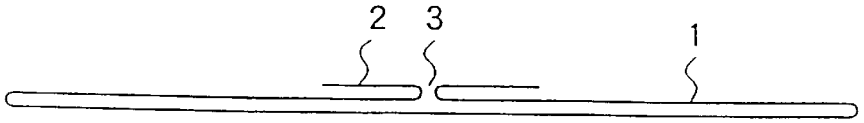
Fig. 1(c) —Prior Art—
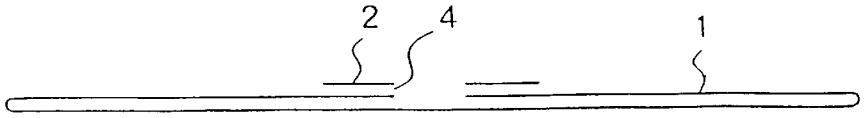

CARRIER-BAG FOR PLATE-SHAPED ARTICLES AND PROCESS FOR PRODUCING THE SAME

BACKGROUND OF THE INVENTION

1. Field of the Invention

The present invention relates to a carrier-bag for plate-shaped articles and a process for producing the carrier-bag. More particularly, the present invention relates to a carrier-bag made of a plastic film which has a simple structure, is easily handled, can be economically produced in accordance with a simple process, and contains plate-shaped articles horizontally and a process for producing this carrier-bag.

2. Description of the Related Arts

In general, plate-shaped articles containing sushi, lunch, Japanese cakes, western cakes, or the like must be carried along in the condition that the articles are held horizontally to protect the content. Such articles used to be wrapped with a wrapping cloth or tied with strings in such a manner that the articles can be held horizontally and carried along. In recent years, more convenient plastic carrier-bags for plate-shaped articles have been used. However, many of the plastic carrier-bags for plate-shaped articles have drawbacks in that the bags are easily broken and that the appearance is inferior.

The present inventors proposed carrier-bags for plate-shaped articles which can improve the above drawbacks in Japanese Utility Model Application Laid-Open No. Showa 59(1984)-60916). FIG. 1(*a*) shows a plan view of this carrier-bag for plate-shaped articles. FIG. 1(*b*) shows a sectional view of this carrier-bag cut along the line A—A, and FIG. 1(*c*) shows a sectional view of this carrier-bag cut along the line B—B. These are carrier-bags which are made of films and comprise a bag part 1 having a plate-shape and holding parts 2 for holding the bag part horizontally. In the carrier-bag, an opening 3 which opens horizontally is formed along the center line of the upper face of the bag part. Two tape films are placed along the edges of the opening from a peripheral part to another peripheral part of the bag part, and both end parts of the tape films are fixed to the peripheral parts of the bag part. One of side edges of each tape film is fixed to the corresponding edge of the opening, and a finger hole 4 is formed at the center of each side edge of the opening.

This carrier-bag for plate-shaped articles can contain a plate-shaped article even when the article has a heavy weight, and the article can be held horizontally even when the article is not balanced in the weight. Therefore, the carrier-bag has acquired good reputation and has been widely used. However, this carrier-bag for plate-shaped articles shows a quality more than necessary for containing a plate-shaped articles having a light weight. Therefore, development of a carrier-bag for plate-shaped articles having a light weight which can be economically produced in accordance with a simpler process and can be used more conveniently has been desired.

SUMMARY OF THE INVENTION

Accordingly, the present invention has an object to provide a carrier-bag for plate-shaped articles made of a plastic film which has a simple structure, is easily handled, can be economically produced in accordance with a simple process, and contains plate-shaped articles horizontally, and to provide a process for producing this carrier-bag.

As the result of extensive studies to achieve the above object, it was found that, when a carrier-bag for plate-shaped articles has a structure in which a containing part is made of a film folded in a W shape, each pair of an outer film and an inner film of the W-shaped film is separately heat sealed together at both side edges of the containing part, and a flat bottom part is formed by bringing two outer folded lines in the W-shaped film to open positions, the carrier-bag has a simple structure, is easily handled, and can be economically produced in accordance with a simple process. The present invention has been completed on the basis of this knowledge.

Accordingly, the present invention provides:

(1) A carrier-bag for plate-shaped articles which comprises:

a containing part made of a film folded in a W shape, wherein each pair of an outer film and an inner film of the W-shaped film is separately heat sealed together at both side edges of the containing part; and a pair of holding parts formed by upward extension of the outer films of the W-shaped film and having finger holes;

(2) A carrier-bag for plate-shaped articles which comprises:

a containing part made of a film folded in a W shape, wherein each pair of an outer film and an inner film of the W-shaped film is separately heat sealed together at both side edges of the containing part; and a pair of holding parts formed by upward extension of the outer films of the W-shaped film, wherein each upper end part is folded outward and then upward to form a v shape at the outside, a finger hole is formed at a folded part of each upper end part, and film portions constituting each v-shaped part are heat sealed to each other and to the outer film of the W-shaped film along downward open lines at both sides of the finger hole;

(3) A carrier-bag described in any of (1) and (2), wherein an arc-shaped notch is formed at each boundary of the heat sealed side edge of the containing part and a side edge of the holding part;

(4) A carrier-bag described in any of (1) and (2), wherein the film of the containing part folded in a W shape is further folded in smaller w shapes at two outer folded portions of the W-shaped film;

(5) A process for producing a carrier-bag for plate-shaped articles which comprises:

(1) forming a belt-shaped film having a pair of W-shaped gazette foldings at both side edges from a long tubular plastic film;

(2) inserting a heat insulating receiving plate into the central part of each W-shaped gazette folding of the belt-shaped film and pushing heat sealing blades to the receiving plate from both sides to separately heat seal each pair of an outer film and an inner film of the W-shaped film together at portions separated by a distance corresponding to a width of the carrier-bag;

(3) cutting the belt-shaped film at the heat sealed portions to produce pieces having a length corresponding to the width of the carrier-bag;

(4) cutting the obtained pieces of the belt-shaped film along a center line in the longitudinal direction; and (5) punching a finger hole in holding parts;

the steps (1) to (5) being conducted while the long tubular plastic film is continuously supplied;

(6) A process for producing a carrier-bag for plate-shaped articles which comprises:

(1) forming a belt-shaped film having a pair of W-shaped gazette foldings at both side edges and two pairs of v-shaped gazette foldings at central parts of an upper face and a lower face from a long tubular plastic film;

(2) cutting the formed belt-shaped film along a center line in the longitudinal direction;

(3) inserting a heat insulating receiving plate between the upper face and the lower face of the central parts and pushing heat sealing blades to the receiving plate from both sides to heat seal two film portions constituting each v-shaped gazette folding and an outer film of a W-shaped gazette folding together along outward open lines;

(4) inserting a heat insulating receiving plate into the central part of each W-shaped gazette folding and pushing heat sealing blades to the receiving plate from both sides to separately heat seal each pair of an outer film and an inner film of the W-shaped film together at portions separated by a distance corresponding to a width of the carrier-bag;

(5) cutting the belt-shaped film at the heat sealed portions to produce pieces having a length corresponding to the width of the carrier-bag; and (6) punching a finger hole in holding parts;

the steps (1) to (6) being conducted while the long tubular plastic film is continuously supplied;

(7) A process described in any of (5) and (6), wherein an arc-shaped notch is formed at each boundary of a heat sealed side edge of a containing part and a side edge of a holding part; and (8) A process described in any of (5) and (6), wherein the belt-shaped film having W-shaped gazette foldings at both side edges formed in (1) further has smaller w-shaped gazette foldings at two outer folded portions of the W-shaped film of each side edge.

BRIEF DESCRIPTION OF THE DRAWINGS

FIG. 1(*a*) shows a plan view of a conventional carrier-bag for plate-shaped articles.

FIG. 1(*b*) shows a sectional view of the carrier-bag shown in FIG. 1(*a*) cut along the line A—A.

FIG. 1(*c*) shows a sectional view of the carrier-bag shown in FIG. 1(*a*) cut along the line B—B.

FIG. 2(*b*) shows a sectional view of the carrier-bag shown in FIG. 2(*a*).

FIG. 2(*c*) shows a perspective view of the carrier-bag shown in FIG. 2(*a*).

FIG. 2(*d*) shows a perspective view of the carrier-bag shown in FIG. 2(*c*) in the condition that two outer folded lines in the W-shaped film are brought to open positions.

FIG. 3(*b*) shows a sectional view of the carrier-bag shown in FIG. 3(*a*) in the condition that two outer folded lines in the W-shaped film are brought to open positions.

FIG. 3(*c*) shows a sectional view of the carrier-bag shown in FIG. 3(*b*) in the condition that the bag contains a plate-shaped article.

FIG. 4(*b*) shows a sectional view of the carrier-bag shown in FIG. 4(*a*) cut along the line D—D.

FIG. 4(*c*) shows a sectional view of the carrier-bag shown in FIG. 4(*b*) in the condition that two outer folded lines in the W-shaped film are brought to open positions.

FIG. 4(*d*) shows a sectional view of the carrier-bag shown in FIG. 4(*c*) in the condition that the bag contains a plate-shaped article.

FIG. 5(*b*) shows a sectional view of the carrier-bag shown in FIG. 5(*a*) cut along the line E—E.

FIG. 6(*b*) shows a sectional view of the carrier-bag shown in FIG. 6(*a*) cut along the line F—F.

FIG. 6(*c*) shows a perspective view of the carrier-bag for plate-shaped articles shown in FIG. 6(*a*).

FIG. 6(*d*) shows a perspective view of the carrier-bag shown in FIG. 6(*c*) in the condition that two outer folded lines in the W-shaped film are brought to open positions.

FIG. 7(*b*) shows a perspective view of the carrier-bag shown in FIG. 7(*a*) in the condition that two outer folded lines in the W-shaped film are brought to open positions.

FIG. 7(*c*) shows a sectional view of the carrier-bag shown in FIG. 7(*a*) in the condition that the bag contains a plate-shaped article.

FIG. 8(*b*) shows a sectional view of the carrier-bag shown in FIG. 8(*a*) cut along the line G—G.

FIG. 8(*c*) shows a perspective view of the carrier-bag shown in FIG. 8(*b*) in the condition that two outer folded lines in the W-shaped film are brought to open positions.

FIG. 8(*d*) shows a sectional view of the carrier-bag shown in FIG. 8(*a*) in the condition that the bag contains a plate-shaped article.

FIG. 9(*b*) shows a sectional view of a belt-shaped film having gazette foldings.

FIG. 9(*c*) shows a sectional view of another embodiment of a belt-shaped film having gazette foldings.

FIG. 11(*b*) shows a sectional view of another embodiment of the belt-shaped film having gazette foldings.

Figure 2A:
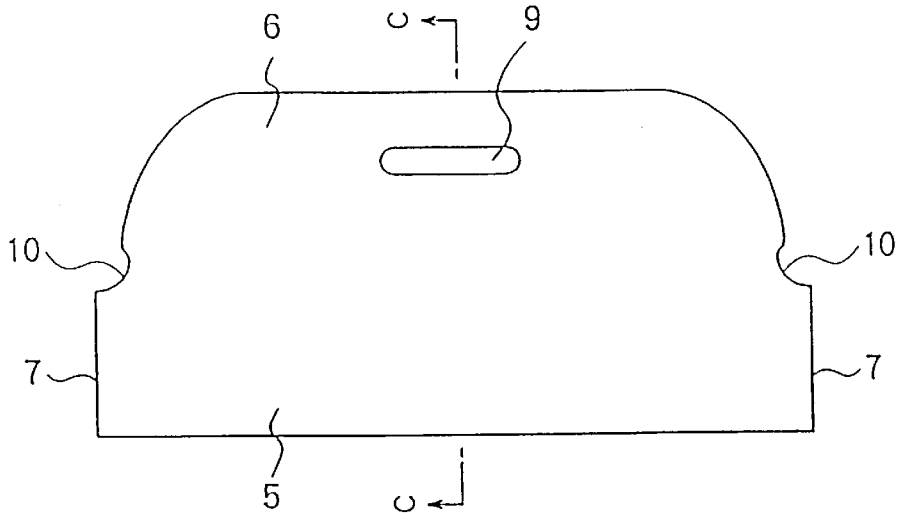
FIG. 2(*a*) shows a plan view of an embodiment of the carrier-bag for plate-shaped articles of the present invention.
Figure 2B:
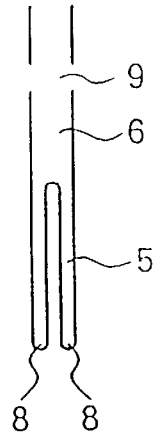
Figure 2C:
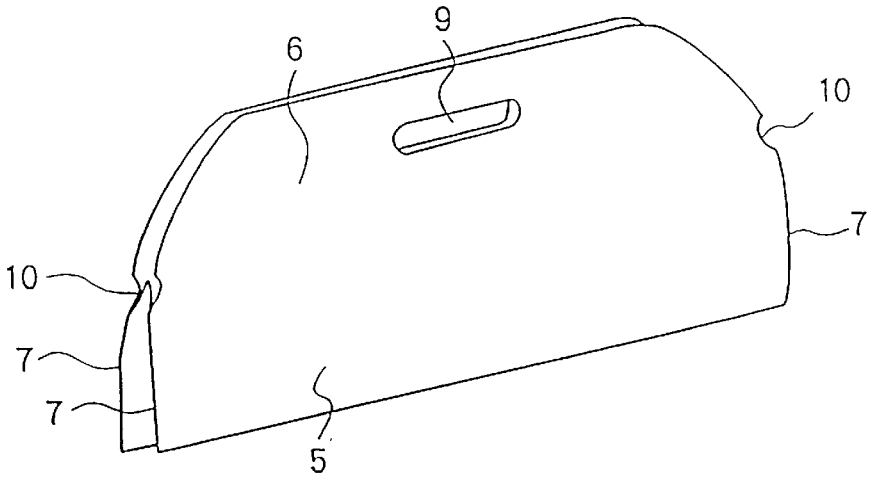
Figure 2D:
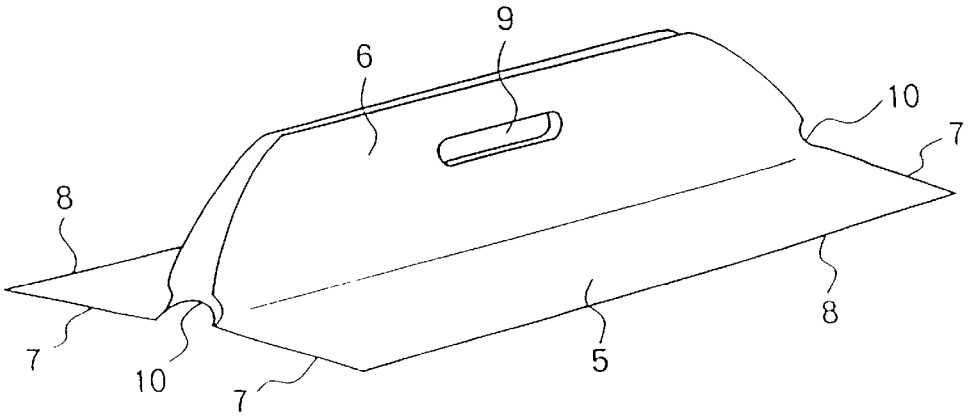

Numbers in the figures have the following meanings:

1 a bag part

2 a holding part

3 an opening

4 a finger hole

5 a containing part

6 a holding part

7 a side edge

8 an outer folded line

9 a finger hole

10 a notch

11 a bottom part
12 a plate-shaped article
13 a heat sealing line
14 a tubular plastic film
15 a gazetter
16 a W-shaped gazette folding
17 a belt-shaped film
18 a receiving plate
19 a heat sealing blade
20 a heat sealed line
21 a carrier-bag for plate-shaped articles
22 a punching blade
23 a receiving plate
24 a v-shaped gazette folding
25 a fixed blade
26 a heat sealing blade
27 a heat sealed line
28 a cutting blade
29 a punching blade
30 a receiving plate

DESCRIPTION OF THE PREFERRED EMBODIMENTS

The carrier-bag for plate-shaped articles of the present invention is produced by using a long tubular plastic film as the material. The long tubular plastic film is not particularly limited as long as it is a thermoplastic film. Examples of such films include films of polyethylene, polypropylene, vinyl chloride resins, polyesters, and nylon. Among these films, polyethylene films and polypropylene films are preferably used because these films can be produced easily in accordance with the inflation process and have good workability. As the plastic film, a single layer film comprising one type of plastic or a laminate film comprising two or more types of plastic can be used.

In the process of the present invention, conventional apparatuses used in processes for producing bags, such as an apparatus for gazette folding, an apparatus for continuously supplying a film, an apparatus for one-pitch transfer, an apparatus for heat sealing, an apparatus for melt cutting, and an apparatus for cutting, can suitably be used.

FIG. 2(*a*) shows a plan view of an embodiment of the carrier-bag for plate-shaped articles of the present invention, and FIG. 2(*b*) shows a sectional view of the carrier-bag shown in FIG. 2(*a*) cut along the line C—C. FIG. 2(*c*) shows a perspective view of the carrier-bag shown in FIG. 2(*a*), and FIG. 2(*d*) shows a perspective view of the carrier-bag shown in FIG. 2(*c*) in the condition that the two outer folded lines in the W-shaped film are brought to open positions. The carrier-bag for plate-shaped articles of the present invention has a structure which comprises a containing part 5 made of a film folded in a W-shape and a pair of holding parts 6 formed by upward extension of the outer films of the W-shaped film. The containing part made of a film folded in a W-shape has a structure in which each pair of an outer film and an inner film of the W-shaped film is separately heat sealed together at both side edges 7 of the containing part, and a flat bottom part can be formed by bringing the two outer folded lines 8 in the W-shaped film to open positions. See FIG. 2(*d*), a finger hole 9 is formed at the upper center of each holding part. An arc-shaped notch 10 is formed at each boundary of the heat sealed side edge of the containing part and a side edge of the holding part.

When this embodiment of the carrier-bag for plate-shaped articles of the present invention is used, the form shown in FIG. 2(*c*) is brought into the form shown in FIG. 2(*d*) having a flat bottom part by bringing the two outer folded lines in the W-shaped film of the containing part to open positions, and a plate-shaped article is placed into the containing part through an opening between the two films of the holding part. By forming an arc-shaped notch at each boundary of the heat sealed side edge of the containing part and the side edge of the holding part, the containing part can be opened widely, and a plate-shaped article can be easily placed into the containing part. After the plate-shaped article has been placed into the containing part, the bag can be carried along with fingers in the finger holes in the condition that the plate-shaped article is held horizontally.

Figure 3A:
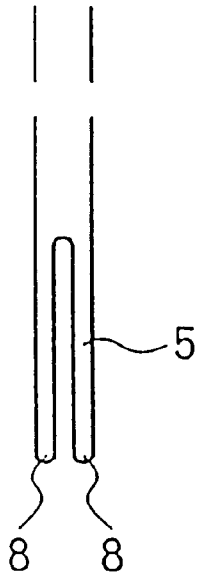
FIG. 3(*a*) shows a sectional view of the carrier-bag shown in FIG. 2(*a*) cut along the line C—C.
Figure 3B:
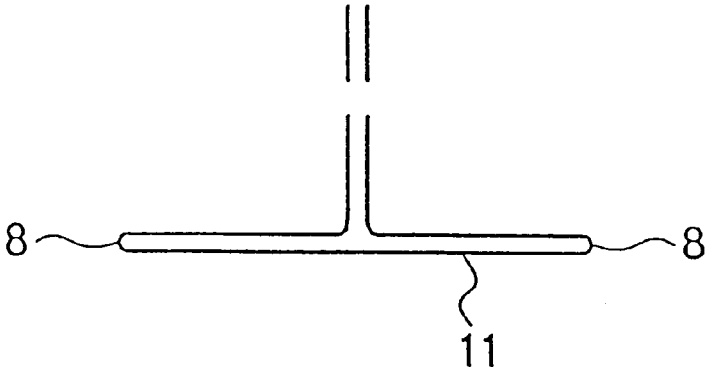
Figure 3C:
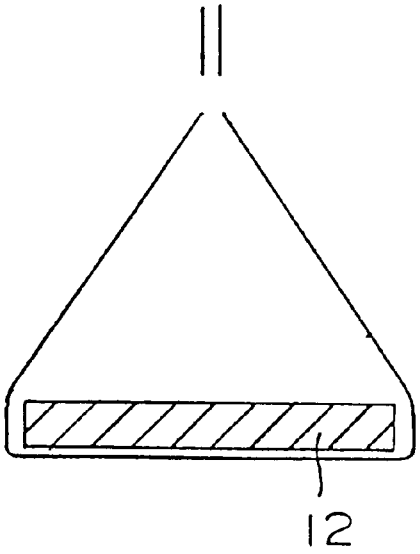
Figure 4A:
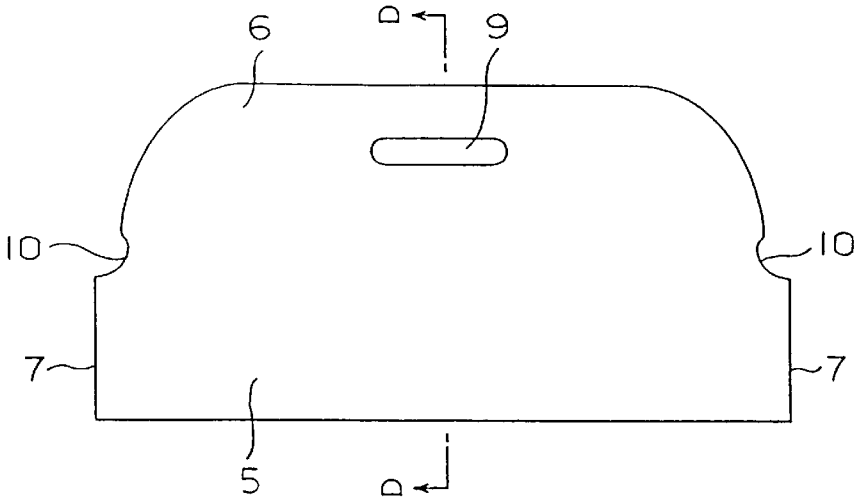
FIG. 4(*a*) shows a plan view of another embodiment of the carrier-bag for plate-shaped articles of the present invention.
Figure 4B:
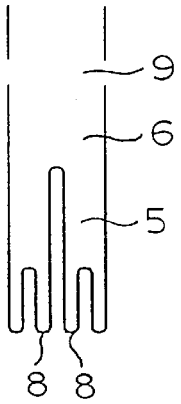
Figure 4C:
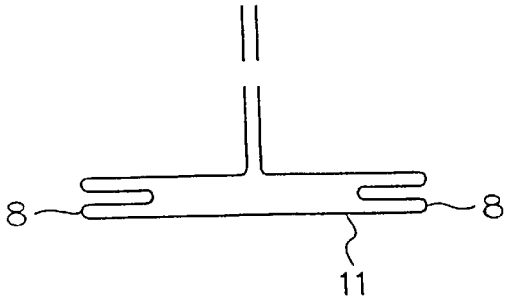
Figure 4D:
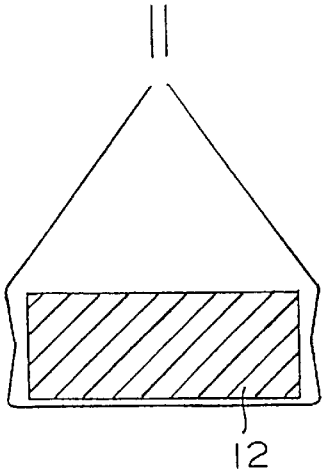

FIGS. 3(*a*), 3(*b*), and 3(*c*) show the manner in which a plate-shaped article is placed in the embodiment of the carrier-bag for plate-shaped articles shown in FIG. 2(*a*). FIG. 3(*a*) shows a sectional view of the carrier-bag shown in FIG. 2(*a*) cut along the line C—C. FIG. 3(*b*) shows a sectional view of the carrier-bag shown in FIG. 3(*a*) in the condition that the two outer folded lines in the W-shaped film are brought to open positions. FIG. 3(*c*) shows a sectional view of the carrier-bag shown in FIG. 3(*b*) in the condition that a plate-shaped article has been placed into the containing part. The carrier-bag in the condition shown in FIG. 3(*a*) is brought into the condition having a bottom part 11 shown in FIG. 3(*b*) by bringing the two folded lines 8 in the W-shaped film of the containing part into open positions, and the plate-shaped article 12 is placed into the bag as shown in FIG. 3(*c*).

In the carrier-bag for plate-shaped articles of the present invention, the number of the folding in the containing part can be increased. FIGS. 4(*a*), 4(*b*), 4(*c*), and 4(*d*) show a plan view and sectional views of another embodiment of the carrier-bag for plate-shaped articles of the present invention. In this embodiment of the carrier-bag for plate-shaped articles, the film of the containing part folded in a W shape is further folded in smaller w shapes at two outer folded portions of the W-shaped film. FIG. 4(*a*) shows a plan view of this embodiment of the carrier-bag for plate-shaped articles. FIG. 4(*b*) shows a sectional view of the carrier-bag shown in FIG. 4(*a*) cut along the line D—D. FIG. 4(*c*) shows a sectional view of the carrier-bag shown in FIG. 4(*b*) in the condition that the two outer folded lines in the larger W shape are brought into open positions to form a horizontal bottom part 11. FIG. 4(*d*) shows a sectional view of the carrier-bag shown in FIG. 4(*c*) in the condition that a plate-shaped article 12 is placed into the containing part. By forming the parts folded in a smaller w-shape at the outer folded portions of the W-shaped film of the containing part, a plate-shaped article having a larger thickness can be contained.

Figure 5A:
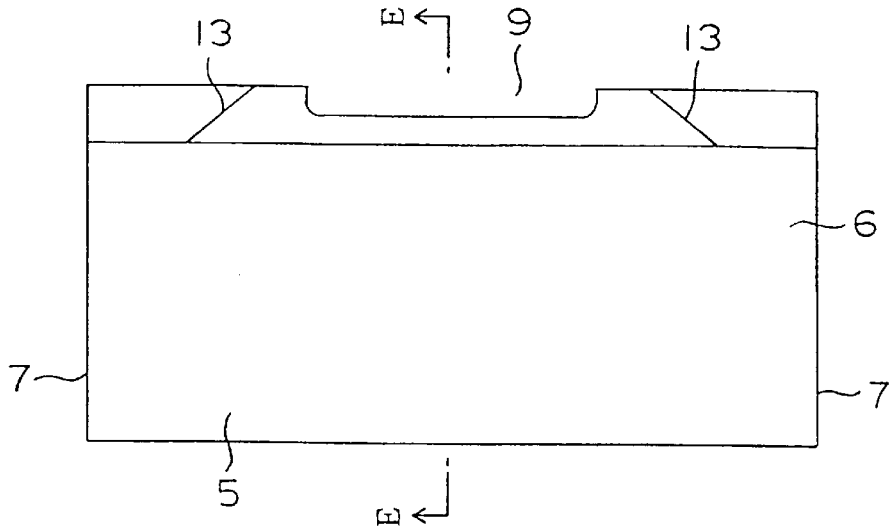
FIG. 5(*a*) shows a plan view of another embodiment of the carrier-bag for plate-shaped articles of the present invention.
Figure 5B:
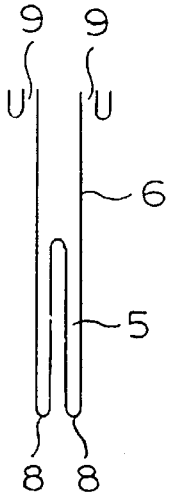
Figure 6A:
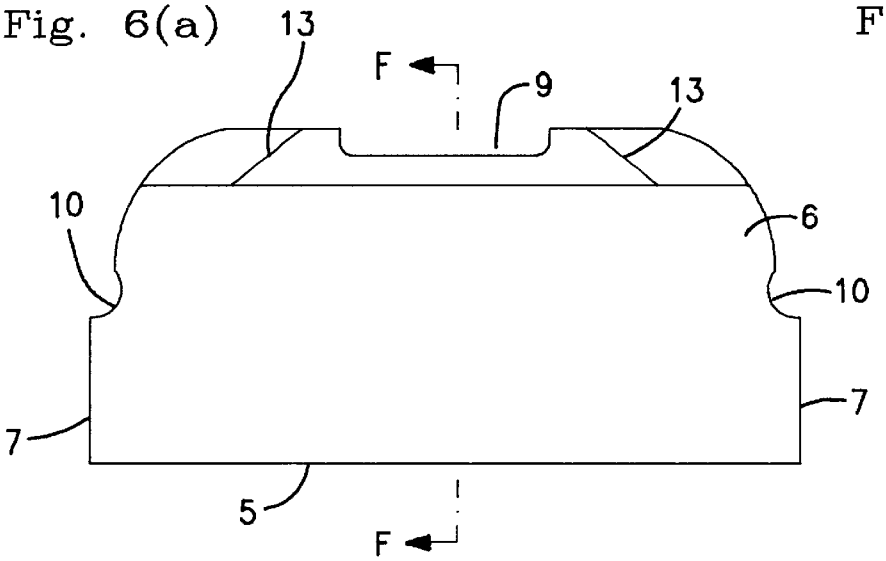
FIG. 6(*a*) shows a plan view of another embodiment of the carrier-bag for plate-shaped articles of the present invention.
Figure 6B:
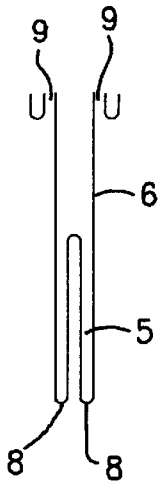
Figure 6C:
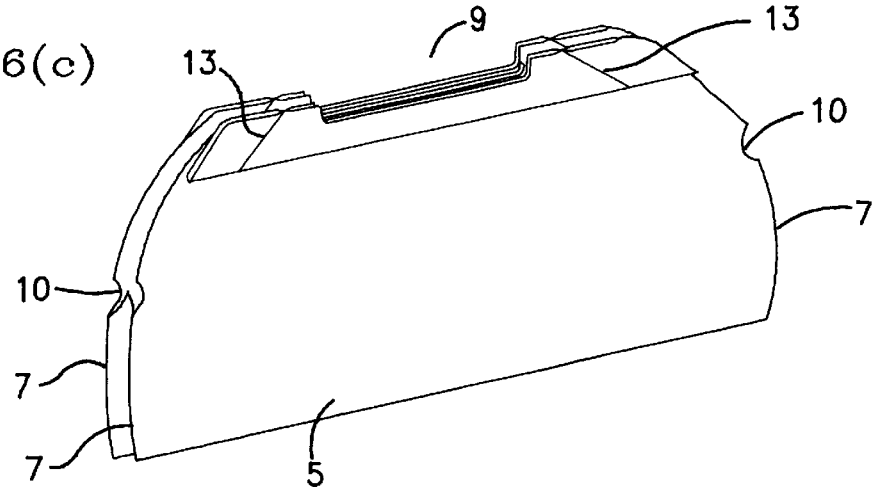
Figure 6D:
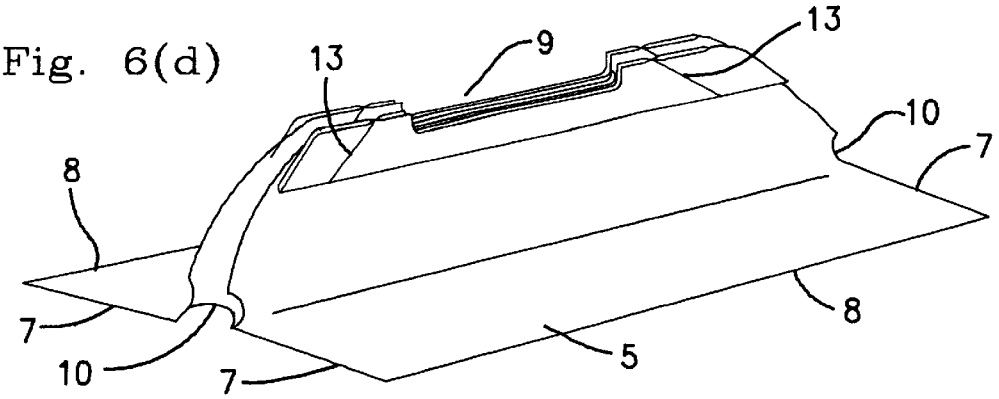

FIG. 5(*a*) shows a plan view of another embodiment of the carrier-bag for plate-shaped articles of the present invention, and FIG. 5(*b*) shows a sectional view of the carrier-bag shown in FIG. 5(*a*) cut along the line E—E. The carrier-bag of the present invention has a containing part 5 made of a film folded in a W shape and a pair of holding parts 6 which is formed by upward extension of the outer films of the W-shaped film. The upper end part of each holding part is folded outward and then upward to form a v shape at the outside, and a finger hole 9 is formed at the folded part of each upper end part. In the containing part made of a film folded in a W shape, each pair of an outer film and an inner film of the W-shaped film is separately heat sealed together at both side edges 7 of the containing part to form a structure which enables forming a horizontal bottom part by bringing two outer folded lines 8 in the W-shaped film to open positions. Film portions constituting each v-shaped part are heat sealed to each other and to the outer film of the W-shaped film along downward open lines 13 at both sides of the finger hole which is formed at the center of the upper end part of the holding part.

FIG. 6(*a*) shows a plan view of another embodiment of the carrier-bag for plate-shaped articles of the present invention, FIG. 6(*b*) shows a sectional view of the carrier-bag shown in FIG. 6(*a*) cut along the line F—F, and FIG. 6(*c*) shows a perspective view of the carrier-bag shown in FIG. 6(*a*). FIG. 6(*d*) shows a perspective view of the carrier-bag shown in FIG. 6(*c*) in the condition that two outer folded lines in the W-shaped film are brought to open positions. This embodiment of the carrier-bag for plate-shaped articles has a containing part 5 made of a film folded in a W shape and a pair of holding parts 6 formed by upward extension of outer films of the W-shaped film. Each upper end part is folded outward and then upward to form a v shape at the outside, and a finger hole 9 is formed at the center of the upper end part of the holding part. Each pair of an outer film and an inner film of the W-shaped film is separately heat sealed together at both side edges 7 of the containing part to form a structure which enables forming a horizontal bottom part by bringing two outer folded lines 8 in the W-shaped film to open positions. In this embodiment of the carrier-bag for plate-shaped articles, an arc-shaped notch 10 is formed at each boundary of the heat sealed side edge of the containing part and the side edge of the holding part, and the edge part from the notch to the upper end of the holding part has a curved shape.

When this embodiment of the carrier-bag for plate-shaped articles is used, the bag in the condition shown in FIG. 6(*c*) is brought into the condition shown in FIG. 6(*d*) having a horizontal bottom part by bringing the two outer folded lines in the W-shaped film to open positions, and a plate-shaped article is placed into the containing part through an opening between the two films of the holding part. This embodiment of the carrier-bag for plate-shaped articles has an arc-shaped notch formed at each boundary of the heat sealed side edge of the containing part and the side edge of the holding part, and the edge part from the notch to the upper end of the holding part has a curved shape. Therefore, the containing part can be widely opened, and a plate-shaped article can be placed into the containing part easily. After the plate-shaped article has been placed into the containing part, the bag can be carried along with fingers in the finger holes in the condition that the plate-shaped article is held horizontally.

Figure 7A:
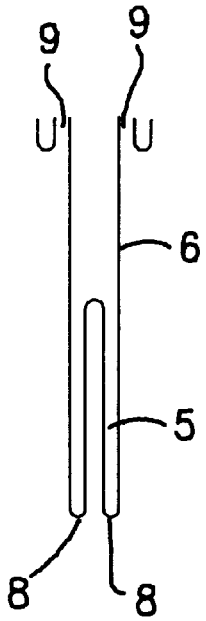
FIG. 7(*a*) shows a sectional view of the carrier-bag shown in FIG. 6(*a*) cut along the line F—F.
Figure 7B:
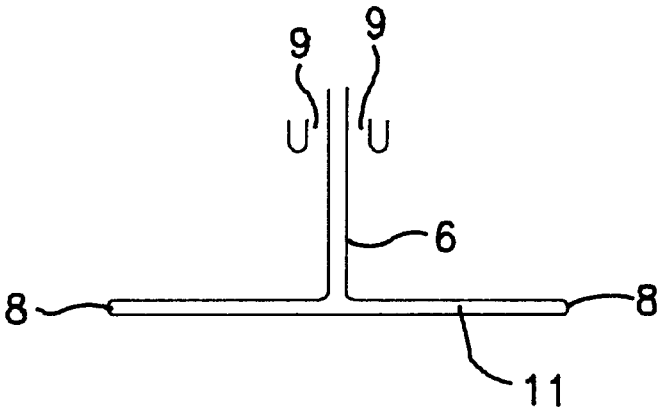
Figure 7C:
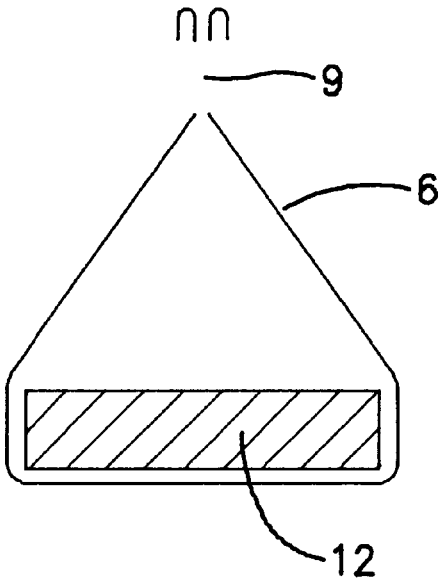
Figure 8A:
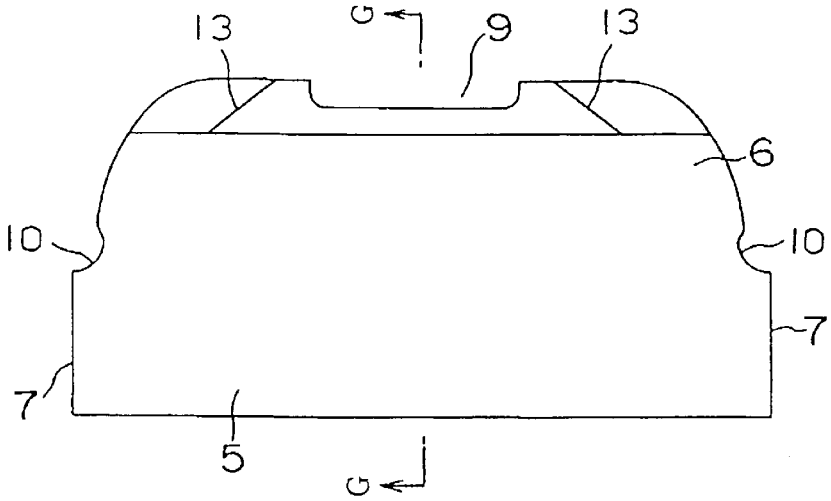
FIG. 8(*a*) shows a plan view of another embodiment of the carrier-bag for plate-shaped articles of the present invention.
Figure 8B:
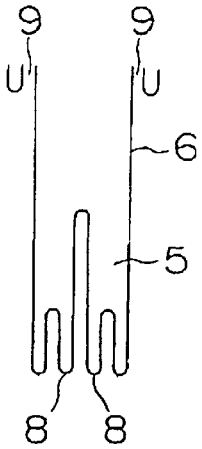
Figure 8C:
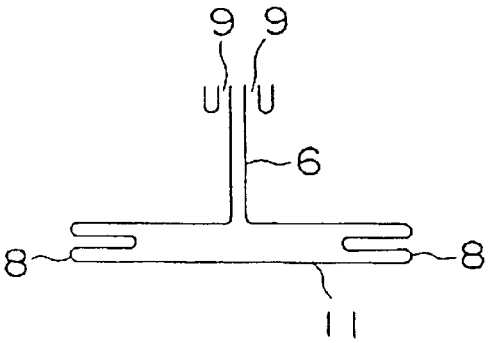
Figure 8D:
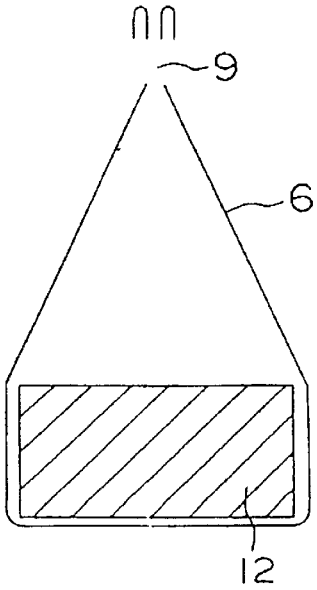

FIGS. 7(*a*), 7(*b*), and 7(*c*) show the manner in which a plate-shaped article is placed in the embodiment of the carrier-bag for plate-shaped articles shown in FIG. 6(*a*). FIG. 7(*a*) shows a sectional view of the embodiment of the carrier-bag shown in FIG. 6(*a*) cut along the line F—F. FIG. 7(*b*) shows a perspective view of the carrier-bag shown in FIG. 7(*a*) in the condition that two outer folded lines in the W-shaped film are brought to open positions. FIG. 7(*c*) shows a sectional view of the carrier-bag shown in FIG. 7(*a*) in the condition that a plate-shaped article has been placed into the carrier-bag. The carrier-bag in the condition shown in FIG. 7(*a*) is brought into the condition shown in FIG. 7(*b*) having a horizontal bottom part 11 by bringing the two outer folded lines 8 in the W-shaped film to open positions, and the plate-shaped article 12 is placed into the carrier-bag as shown in FIG. 7(*c*).

In the carrier-bag for plate-shaped articles of the present invention, the number of the folding in the containing part can be increased. FIGS. 8(*a*), 8(*b*), 8(*c*), and 8(*d*) show a plan view and sectional views of another embodiment of the carrier-bag for plate-shaped articles of the present invention. In this embodiment of the carrier-bag for plate-shaped articles, the film of the containing part folded in a W shape is further folded in smaller w shapes at two outer folded portions of the W-shaped film. FIG. 8(*a*) shows a plan view of this embodiment of the carrier-bag for plate-shaped articles. FIG. 8(*b*) shows a sectional view of the carrier-bag shown in FIG. 4(*a*) cut along the line G—G. FIG. 8(*c*) shows a sectional view of the carrier-bag shown in FIG. 4(*b*) in the condition that the two outer folded lines in the larger W shape are brought into open positions to form a horizontal bottom part 11. FIG. 8(*d*) shows a sectional view of the carrier-bag shown in FIG. 8(*c*) in the condition that a plate-shaped article 12 is placed into the containing part. By forming the parts folded in a smaller w-shape at the outer folded portions of the W-shaped film of the containing part, a plate-shaped article having a larger thickness can be contained.

An embodiment of the process for producing a carrier-bag for plate-shaped articles of the present invention comprises the following steps:

(1) forming a belt-shaped film having a pair of W-shaped gazette foldings at both side edges from a long tubular plastic film;

(2) inserting a heat insulating receiving plate into the central part of each W-shaped gazette folding of the belt-shaped film and pushing heat sealing blades to the receiving plate from both sides to separately heat seal each pair of an outer film and an inner film of the W-shaped film together at portions separated by a distance corresponding to a width of the carrier-bag;

(3) cutting the belt-shaped film at the heat sealed portions to produce pieces having a length corresponding to the width of the carrier-bag;

(4) cutting the obtained pieces of the belt-shaped film along a center line in the longitudinal direction; and (5) punching a finger hole in holding parts.

These steps are conducted while the long tubular plastic film is continuously supplied.

Figure 9A:
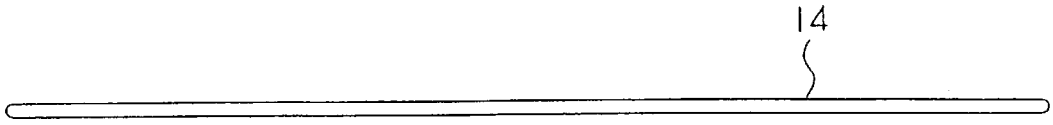
FIG. 9(*a*) shows a sectional view of a tubular film.
Figure 9B:
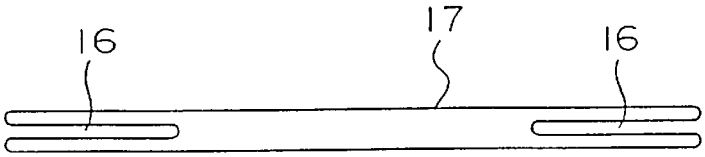
Figure 9C:
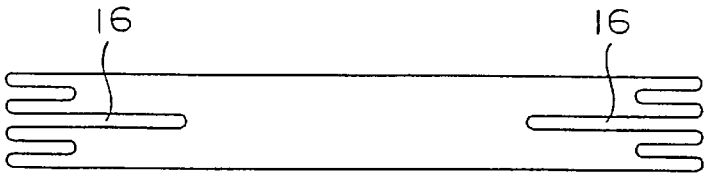
Figure 10:
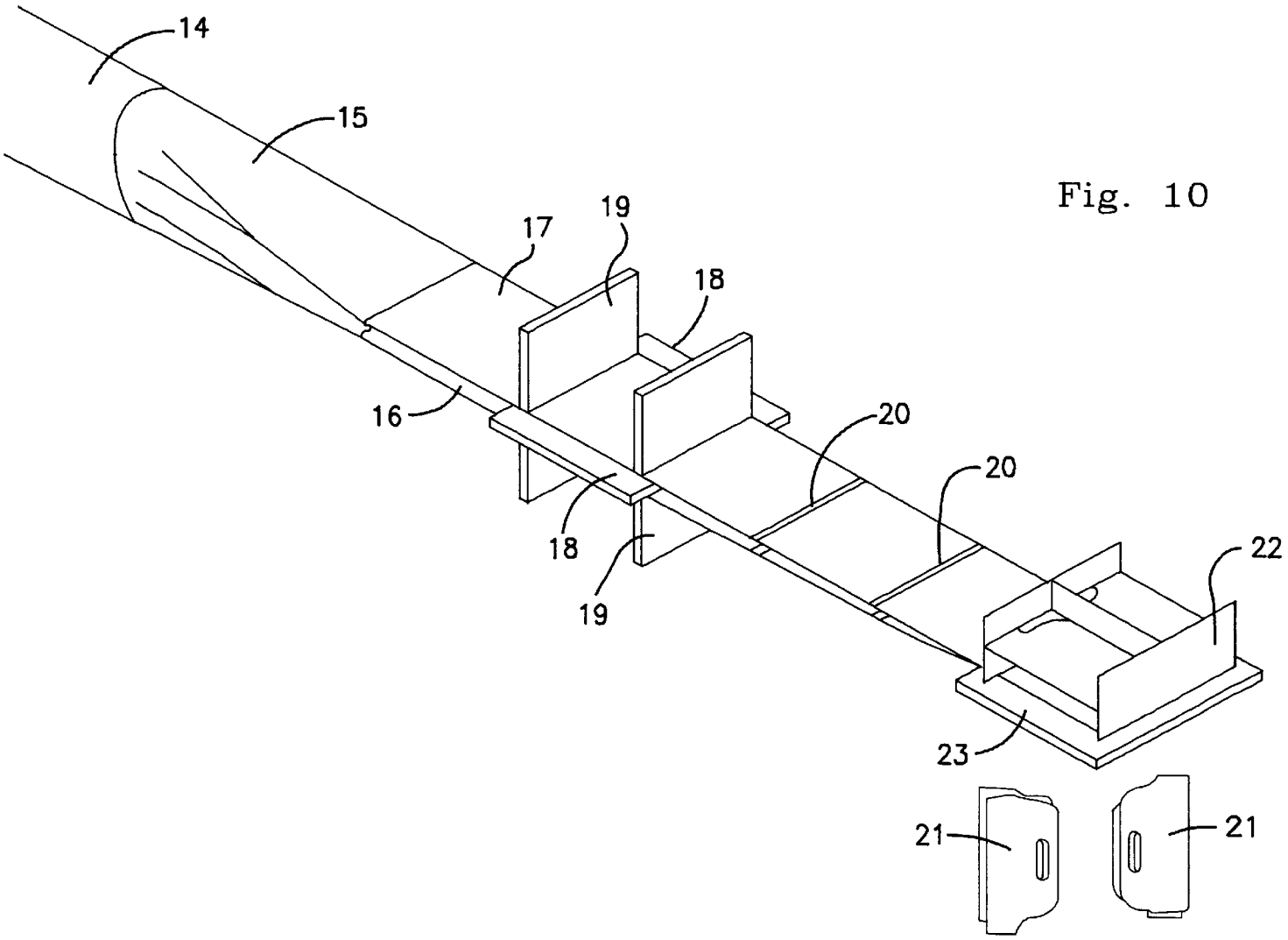
FIG. 10 shows a schematic diagram describing an embodiment of the process of the present invention.

FIGS. 9(*a*), 9(*b*), and 9(*c*) show sectional views of a tubular film and belt-shaped films having gazette foldings. FIG. 10 shows a schematic diagram describing this embodiment of the process of the present invention. A long tubular plastic film 14 shown in FIG. 9(*a*) is supplied to a gazetter 15, and a belt-shaped film 17 having W-shaped gazette foldings 16 at both side edges shown in FIG. 9(*b*) is formed. Where necessary, a belt-shaped film having a shape shown in FIG. 9(*c*), in which smaller w-shaped gazette foldings are formed at the outer folded portions of the W-shaped film in each of the above gazette folding, may be formed. The gazette foldings are formed by continuously supplying a long tubular plastic film inflated by an inner air pressure to a starting part of the gazetter having a circular sectional shape. The ending part of the gazetter has the same sectional shape as that of the belt-shaped film having the gazette foldings shown in FIG. 9(*b*). The sectional shape of the gazetter changes gradually from a circular shape at the starting part to the above shape at the ending part. The film is gradually formed into the belt-shaped film having the gazette foldings while being transferred through the gazetter. After leaving the ending part of the gazetter, the belt-shaped film having the gazette foldings is held between nip rolls (not shown in the figure) and transferred to the next step. By holding the belt-shaped film between the nip rolls, the air inside the tubular plastic film is prevented from flowing into parts at the downstream of the nip rolls, and the belt-shaped film having gazette foldings can keep the shape with stability.

In this embodiment of the process, a heat insulating receiving plate 18 is inserted into the central part of each W-shaped gazette folding of the belt-shaped film formed above, and heat sealing blades 19 are pushed to the receiving plate from both sides to separately heat seal each pair of an outer film and an inner film of the W-shaped film together at portions separated by a distance corresponding to a width of the carrier-bag. Two pairs of heat sealing blades each composed of upper and lower heat sealing blades may be used simultaneously at portions separated by the distance corresponding to the width of the carrier-bag as shown in FIG. 10. Alternatively, a single pair of sealing blades composed of upper and lower heat sealing blades may be used, and the heat sealed parts may be formed successively at portions separated by the distance corresponding to the width of the carrier-bag by transferring the belt-shaped film by the distance corresponding to the width of the bag in a one-pitch transfer. It is sufficient that the film is heat sealed only at the portions of the W-shaped gazette foldings which make the containing parts of the carrier-bags for plate-shaped articles. However, when the carrier-bag for plate-shaped articles has arc-shaped notches and curved edges from the notches to the upper end of the holding part shown in FIG. 2(*a*), it does not cause any problem that the film is heat sealed also at the portion having two films which make the holding parts because the heat sealed portion in this portion is removed by cutting in the last step.

In this embodiment of the process, it is preferable that a heat sealing blade having such a structure that a single heat sealing blade simultaneously forms two heat sealed lines separated in a small distance, i.e., a so-called structure of parallel double blades, is used so that adjacent heat sealed side edges for successive two bags are formed simultaneously. In the process of the present invention, the heat insulating receiving plate is inserted into the central part of each W-shaped gazette folding of the belt-shaped film, and the films are heat sealed together by pushing the heat sealing blades to the receiving plate from both sides. Therefore, each pair of an outer film and an inner film of the W-shaped film is separately heat seal together, and there is no possibility that the four films constituting the W-shaped gazette folding are heat sealed together. By separately heat sealing each pair of an outer film and an inner film of the W-shaped film together, the containing part folded in a W-shape is formed in the carrier-bag for plate-shaped articles of the present invention, and a flat bottom part can be formed by bringing the two outer folded lines of the W-shaped film to open positions.

In the process of the present invention, the belt-shaped film in which heat sealed lines 20 have been formed at the portions separated by a distance corresponding to the width of a carrier-bag is cut in such a manner that the sealed lines make both sides edges of the containing part having a W-shaped folding, and pieces having a length corresponding to the width of the carrier-bag are produced. The pieces of the belt-shaped film obtained above are cut along the center line in the longitudinal direction. Then, a finger hole is punched in the holding parts, and, where necessary, an arc-shaped notch is formed at each boundary of the heat sealed side edge of the containing part and a side edge of the holding part. Thus, the carrier-bag for plate-shaped articles 21 of the present invention is completed. When one piece of the belt-shaped film is cut along the center line in the longitudinal direction, two carrier-bags for plate-shaped articles of the present invention can be obtained, i.e., one from each side of the belt-shaped film. The combination of the procedures of cutting, punching a finger hole, and forming notches and curved edges is not particularly limited. In the embodiment shown in FIGS. 9(*a*), 9(*b*), and 9(*c*), these procedures are conducted in a single step by using a punching blade 22 and a receiving plate 23. However, it is also possible, for example, that after the belt-shaped film has been cut into pieces having the length corresponding to the width of the bag, procedures of cutting the obtained pieces along the center line in the longitudinal direction, punching a finger hole, and forming arc-shaped notches and curved edges are simultaneously conducted in one step, or that all these procedures are conducted successively in separate steps. In accordance with the process of the present invention, a carrier-bag for plate-shaped articles can be produced economically with excellent productivity because two carrier-bags can be obtained from one piece of the tubular film having the length corresponding to the width of the carrier-bag.

Another embodiment of the process for producing a carrier-bag for plate-shaped articles of the present invention comprises:

(1) forming a belt-shaped film having a pair of W-shaped gazette foldings at both side edges and two pairs of v-shaped gazette foldings at central parts of an upper face and a lower face from a long tubular plastic film;

(2) cutting the formed belt-shaped film along a center line in the longitudinal direction;

(3) inserting a heat insulating receiving plate between the upper face and the lower face of the central parts and pushing heat sealing blades to the receiving plate from both sides to heat seal two film portions constituting each v-shaped gazette folding and an outer film of a W-shaped gazette folding together along outward open lines;

(4) inserting a heat insulating receiving plate into the central part of each W-shaped gazette folding and pushing heat sealing blades to the receiving plate from both sides to separately heat seal each pair of an outer film and an inner film of the W-shaped film together at portions separated by a distance corresponding to a width of the carrier-bag;

(5) cutting the belt-shaped film at the heat sealed portions to produce pieces having a length corresponding to the width of the carrier-bag; and (6) punching a finger hole in holding parts.

The steps (1) to (6) are conducted while the long tubular plastic film is continuously supplied.

Figure 11A:
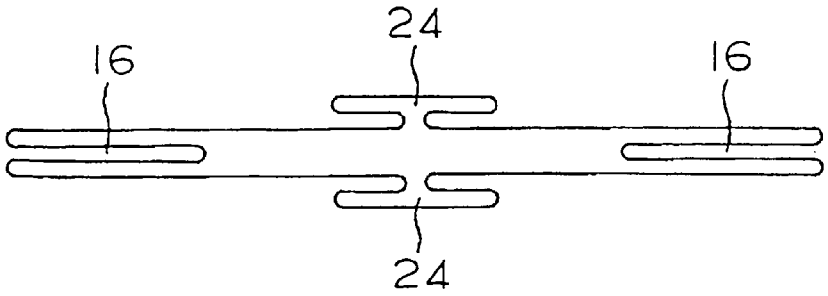
FIG. 11(*a*) shows a sectional view of another embodiment of the belt-shaped film having gazette foldings.
Figure 11B:
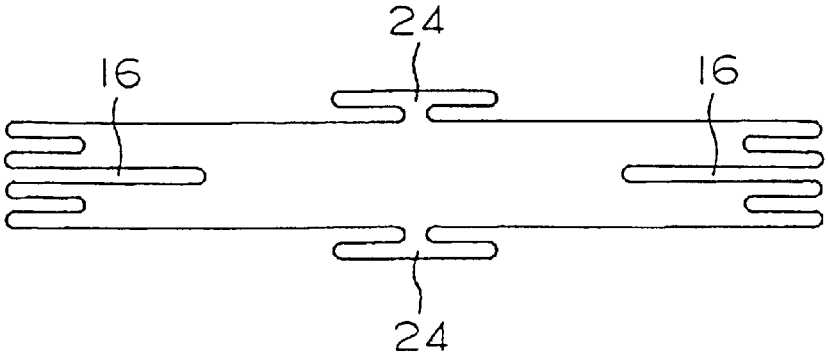
Figure 12:
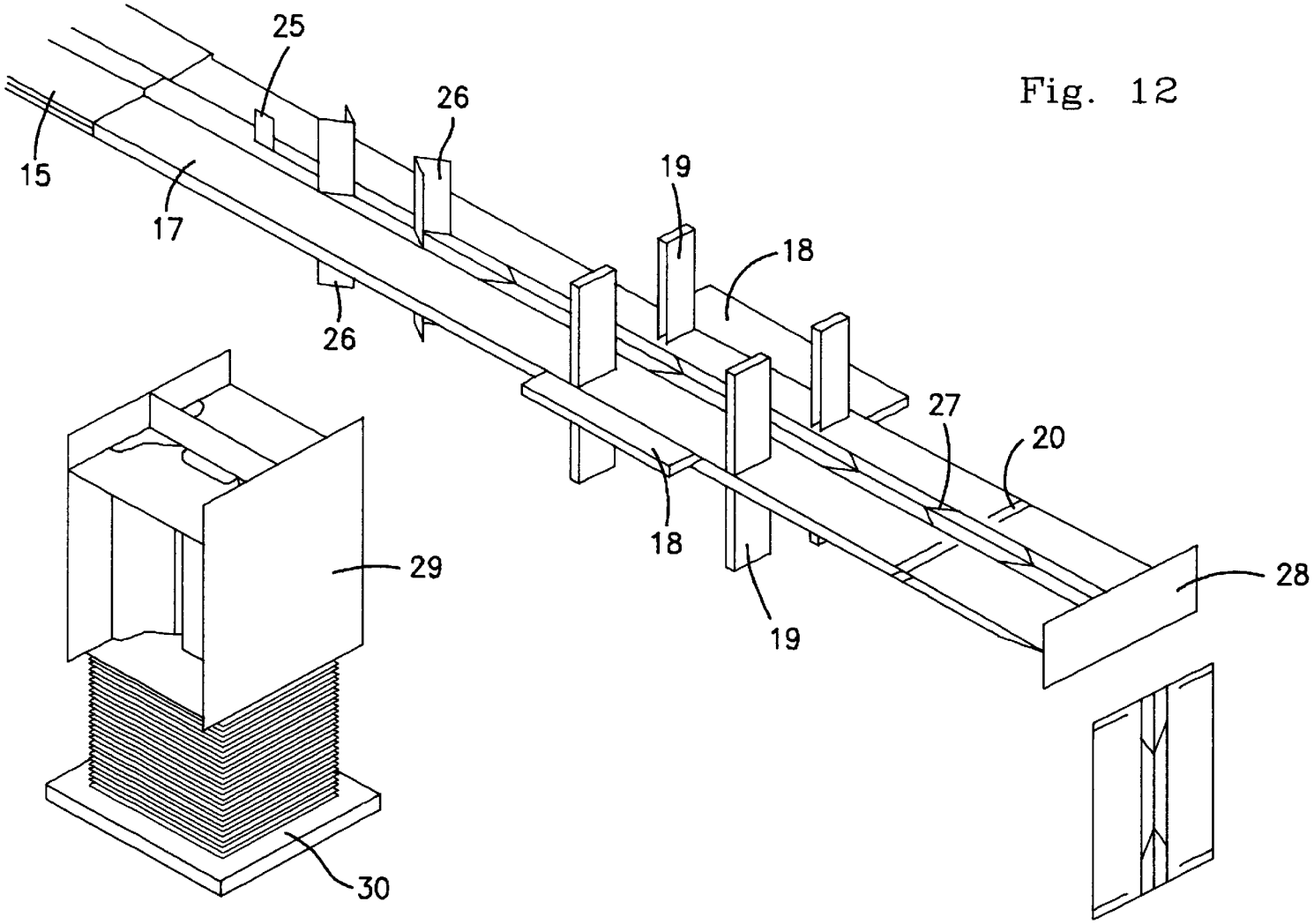
FIG. 12 shows a schematic diagram describing another embodiment of the process of the present invention.

FIGS. 11(*a*) and 11(*b*) show sectional views of a belt-shaped film having gazette foldings, and FIG. 12 shows a schematic diagram describing the present embodiment of the process. A long tubular plastic film is supplied to a gazetter 15, and a belt-shaped film 17 having a pair of W-shaped gazette foldings 16 at both side edges and two pairs of v-shaped gazette foldings 24 at central parts of an upper face and a lower face as shown in FIG. 11(*a*) is formed. Where necessary, a belt-shaped film having a shape shown in FIG. 11(*b*), in which smaller gazette foldings are formed at the outer folded portions in the above W-shaped gazette foldings, may be formed. The gazette foldings are formed by continuously supplying a long tubular plastic film inflated by an inner air pressure to a starting part of the gazetter having a circular sectional shape. The ending part of the gazetter has the same sectional shape as that of the belt-shaped film having the gazette foldings shown in FIG. 11(*a*). The sectional shape of the gazetter changes gradually from a circular shape at the starting part to the above shape at the ending part. The film is gradually formed into the belt-shaped film having the gazette foldings while being transferred through the gazetter. After leaving the ending part of the gazetter, the belt-shaped film having the gazette foldings is held between nip rolls (not shown in the figure) and transferred to the next step. By holding the belt-shaped film between the nip rolls, the air inside the tubular plastic film is prevented from flowing into parts at the downstream of the nip rolls, and the belt-shaped film having gazette foldings can keep the shape with stability.

In this embodiment of the process, the belt-shaped film formed above is cut along the center line in the longitudinal direction of the film. The upper film alone or both upper and lower films of the belt-shaped film may be cut along the center line of the film. The belt-shaped film can be cut along the center line of the film by using a fixed blade 25. When the upper film alone is cut, a receiving plate is placed between the upper and lower films. When both upper and lower films are cut, a receiving plate is placed under the lower film. In the embodiment shown in FIG. 12, the upper film alone is cut.

In this embodiment of the process, a heat insulating receiving plate (not shown in the figure) is inserted between the upper and lower films at the central part of the belt-shaped film which has been cut along the center line, and heat sealing blades 26 are pushed to the receiving plate from both sides to heat seal two film portions constituting each v-shaped gazette folding and an outer film of a W-shaped gazette folding together along outward open lines. Then, a heat insulating receiving plate 18 is inserted into the central part of each W-shaped gazette folding of the belt-shaped film formed above, and heat sealing blades 19 are pushed to the receiving plate from both sides to separately heat seal each pair of an outer film and an inner film of the W-shaped film together at portions separated by a distance corresponding to a width of the carrier-bag. It is preferable that a heat sealing blade having such a structure that a single heat sealing blade simultaneously forms two heat sealed lines separated in a small distance, i.e., a so-called structure of parallel double blades, is used so that adjacent heat sealed side edges for successive two bags are formed simultaneously.

In this embodiment of the process, the heat insulating receiving plate is inserted into the central part of each W-shaped gazette folding of the belt-shaped film, and the films are heat sealed together by pushing the heat sealing blades to the receiving plate from both sides. Therefore, each pair of an outer film and an inner film of the W-shaped film is separately heat seal together, and there is no possibility that the four films constituting the W-shaped gazette folding are heat sealed together. By separately heat sealing each pair of an outer film and an inner film of the W-shaped film together, the containing part folded in a W-shape is formed in the carrier-bag for plate-shaped articles of the present invention, and a flat bottom part can be formed by bringing the two outer folded lines of the W-shaped film to open positions. Two pairs of heat sealing blades each composed of upper, lower, right, and left sealing blades may be used simultaneously at portions separated by the distance corresponding to the width of the carrier-bag as shown in FIG. 12. Alternatively, a single pair of sealing blades composed of upper, lower, right, left heat sealing blades may be used, and the heat sealed parts may be formed successively at portions separated by the distance corresponding to the width of the carrier-bag by transferring the belt-shaped film by the distance corresponding to the width of the bag in a one-pitch transfer.

In this embodiment of the process, the belt-shaped film, in which heat sealed lines 27 have been formed along the outward expanded lines and heat sealed lines 20 have been formed at the portions separated by a distance corresponding to the width of a carrier-bag, is cut in such a manner that the sealed lines make both sides edges of the containing part having a W-shaped folding, and pieces having a length corresponding to the width of the carrier-bag are produced. When the upper film of the belt-shaped film alone has been cut along the center line in the longitudinal direction, the lower film is also cut along the center line in the longitudinal direction. A finger hole is punched in each piece at a position between the heat sealed lines formed along the outward expanded lines. Where necessary, arc-shaped notches are formed at boundaries of the heat sealed side edges of the containing part and side edges of the holding part, and curved edges are formed from the notches to the upper end of the holding part. Thus, the carrier-bag of the present invention is completed. The combination of the procedures of cutting, punching a finger hole, and forming notches and curved edges is not particularly limited. In the embodiment shown in FIG. 12, after the belt-shaped film has been cut to the length corresponding to the width of the carrier-bag by using a cutting blade 28, procedures of cutting the belt-shaped film along the center line in the longitudinal direction, punching finger holes, and forming notches and curved edges are conducted separately in a single step by using a punching blade 29 and a receiving plate 30. However, it is also possible that, for example, all these procedures are conducted in separate steps. It is also possible that punching blades and receiving plates are disposed at the end of the heat sealing line, and the procedures of cutting and punching are conducted as a step in the line. In accordance with the process of the present invention, a carrier-bag for plate-shaped articles can be produced economically with excellent productivity because two carrier-bags can be obtained from one piece of the tubular film having the length corresponding to the width of the carrier-bag.

To summarize the advantages of the present invention, the carrier-bag for plate-shaped articles has a simple structure, is easily handled, and can contain plate-shaped articles horizontally. In accordance with the process of the present invention, the carrier-bag can be produced from a tubular plastic film continuously and easily in a simple process. The process show particularly excellent productivity because two carrier-bags can be obtained from one piece of the tubular film having the length corresponding to the width of the carrier-bag.

What is claimed is:

1. A carrier-bag for plate-shaped articles which comprises:

a rectangular containing part made of a film folded in a W shape, wherein each pair of an outer film and an inner film of the W-shaped film is separately heat sealed together at both side edges of the rectangular containing part; and a pair of holding parts formed by upward extension of the outer films of the W-shaped film and having finger holes, said pair of holding parts opening apart from each other at a point where the heat sealing of said inner and outer films terminates.

2. A carrier-bag for plate-shaped articles which comprises:

a rectangular containing part made of a film folded in a W shape, wherein each pair of an outer film and an inner film of the W-shaped film is separately heat sealed together at both side edges of the rectangular containing part; and a pair of holding parts of separated films formed by upward extension of the outer films of the W-shaped film each holding part comprising an upper end part, wherein each of the upper end parts is folded outward and then upward to form a V shape at the outside, a finger hole is formed at a folded part of each upper end part, and film portions constituting each V-shaped part are heat sealed to each other and to the outer film of the W-shaped film along downward open lines at both sides of the finger hole.

3. A carrier-bag according to claim 1, wherein an arc-shaped notch is formed at each boundary of the heat sealed side edge of the rectangular containing part and a side edge of the holding part.

4. A carrier-bag according to claim 2, wherein an arc-shaped notch is formed at each boundary of the heat sealed side edge of the rectangular containing part and a side edge of the holding part.

5. A carrier-bag according to claim 1, wherein the film of the rectangular containing part folded in a W shape is further folded horizontally and parallel to the holding part in smaller w shapes at two outer folded portions of the W-shaped film.

6. A carrier-bag according to claim 2, wherein the film of the rectangular containing part folded in a W shape is further folded horizontally and parallel to the holding part in smaller w shapes at two outer folded portions of the W-shaped film.

7. A carrier-bag according to claim 1, wherein said pair of holding parts comprise side and top edges which do not connect with those of the other holding part and permit the holding parts to be spread open at a joint point with said rectangular containing part to accept the plate-shaped article.

8. A carrier-bag according to claim 7, wherein said holding parts open to define an opening in registration with and equal in size to a size of a base of said rectangular containing part.

* * * * *